US008676584B2

(12) United States Patent
Schlosser

(10) Patent No.: US 8,676,584 B2
(45) Date of Patent: Mar. 18, 2014

(54) METHOD FOR TIME SCALING OF A SEQUENCE OF INPUT SIGNAL VALUES

(75) Inventor: Markus Schlosser, Hannover (DE)

(73) Assignee: Thomson Licensing, Issy-les-Moulineaux (FR)

( * ) Notice: Subject to any disclaimer, the term of this patent is extended or adjusted under 35 U.S.C. 154(b) by 976 days.

(21) Appl. No.: 12/456,741

(22) Filed: Jun. 22, 2009

(65) Prior Publication Data

US 2010/0004937 A1 Jan. 7, 2010

(30) Foreign Application Priority Data

Jul. 3, 2008 (EP) ..... 08159578

(51) Int. Cl.

| | |
|---|---|
| ***G10L 19/02*** | (2013.01) |
| ***G10L 21/00*** | (2013.01) |
| ***G10L 13/00*** | (2006.01) |
| ***G10L 13/08*** | (2013.01) |

(52) U.S. Cl.
USPC ..... 704/258; 704/260; 704/203; 704/211

(58) Field of Classification Search
USPC ..... 704/258, 260, 203, 211
See application file for complete search history.

(56) References Cited

U.S. PATENT DOCUMENTS

| | | | | |
|---|---|---|---|---|
| 5,341,432 | A | 8/1994 | Suzuki et al. | |
| 5,682,501 | A * | 10/1997 | Sharman | 704/260 |
| 5,689,440 | A * | 11/1997 | Leitch et al. | 370/313 |
| 5,806,023 | A * | 9/1998 | Satyamurti | 704/211 |
| 5,828,995 | A | 10/1998 | Satyamurti et al. | |
| 6,173,263 | B1 * | 1/2001 | Conkie | 704/260 |
| 6,266,637 | B1 * | 7/2001 | Donovan et al. | 704/258 |
| 6,324,501 | B1 * | 11/2001 | Stylianou et al. | 704/211 |
| 6,366,883 | B1 * | 4/2002 | Campbell et al. | 704/260 |
| 6,718,309 | B1 * | 4/2004 | Selly | 704/503 |
| 7,467,087 | B1 * | 12/2008 | Gillick et al. | 704/260 |
| 7,565,289 | B2 * | 7/2009 | Rogers | 704/229 |

(Continued)

FOREIGN PATENT DOCUMENTS

| | | |
|---|---|---|
| JP | 11501405 | 2/1999 |
| JP | 2005221811 | 8/2005 |

OTHER PUBLICATIONS

Mike Demol et al: "Efficient Non-Uniform Time Scaling of Speech with WSOLA" Proceeding of Speech and Computers (SPECOM) 2005, Oct. 17, 2005, Oct. 19, 2005 pp. 163-166, XP002493083, *p. 164*.

(Continued)

*Primary Examiner* — Eric Yen
(74) *Attorney, Agent, or Firm* — Myers Wolin LLC

(57) ABSTRACT

The invention relates to a digital signal processing technique that changes the length of an audio signal and, thus, effectively its play-out speed. This is used for frame rate conversion or sound effects in music production. Time scaling may further be used for fast forward or slow-motion audio play-out.

According said method the waveform similarity overlap add approach is modified such that a maximized similarity is determined among similarity measures of sub-sequence pairs each comprising a sub-sequence to-be-matched from a input window and a matching sub-sequence from a search window wherein said sub-sequence pairs comprise at least two sub-sequence pairs of which a first pair comprises a first sub-sequence to-be-matched and a second pair comprises a different second sub-sequence to-be-matched.

The input window allows for finding sub-sequence pairs with higher similarity than with a WSOLA approach based on a single sub-sequence to-be-matched. This results in less perceivable artefacts.

6 Claims, 2 Drawing Sheets

(56) References Cited

U.S. PATENT DOCUMENTS

| | | | | |
|---|---|---|---|---|
| 7,693,716 | B1 * | 4/2010 | Davis et al. | 704/260 |
| 7,856,357 | B2 * | 12/2010 | Mizutani et al. | 704/261 |
| 7,873,515 | B2 * | 1/2011 | Padhi et al. | 704/228 |
| 7,917,360 | B2 * | 3/2011 | Rogers | 704/229 |
| 7,957,960 | B2 * | 6/2011 | Chen | 704/211 |
| 8,027,837 | B2 * | 9/2011 | Silverman et al. | 704/268 |
| 8,185,395 | B2 * | 5/2012 | Ariyoshi et al. | 704/260 |
| 8,401,865 | B2 * | 3/2013 | Ojala et al. | 704/504 |

OTHER PUBLICATIONS

Sungjoo Lee et al: "Variable time-scale modification of speech using transient information" Acoustics, Speech, and Signal Processing, 1997, ICASSP-97., 1997 IEEE International Conference on Munich, Germany Apr. 21-24, 1997, Los Alamitos, CA, USA, IEEE Comput. Soc, US, vol. 2, Apr. 21, 1997, pp. 1319-1322, XP010226045 ISBN: 978-8186-7179-3, *p. 1320*.

Verhelst W et al: "An overlap-add technique based on waveform similarity (WSOLA) for high quality time-scale modification of speech" Plenary, Special, Audio, Underwater Acoustics, VLSI, Neural Networks. Minneapolis, Apr. 27-30, 1993; [Proceedings of the International Conference on Acoustics, Speech, and Signal Processing (ICASSP)], New York, IEEE, US, vol. 2, Apr. 27, 1993, pp. 554-557, XP010110516, ISBN: 978-0-7803-0946-3 *the whole document*.

Demol, M. et al., "Efficient Non-Uniform Time-Scaling of Speech with WSOLA", Proceedings of 10th International Conference Speech Computing (SPECOM), Patras, Greece, Oct. 17, 2005, pp. 163-166.

* cited by examiner

METHOD FOR TIME SCALING OF A SEQUENCE OF INPUT SIGNAL VALUES

This application claims the benefit, under 35 U.S.C. §119, of European Patent Application No. 08159578.7 of 3 Jul. 2008.

FIELD OF THE INVENTION

The invention relates to a digital signal processing technique that changes the length of an audio signal and, thus, effectively its play-out speed. This is used in the professional market for frame rate conversion in the film industry or sound effects in music production. Furthermore, consumer electronics devices, like e.g. mp3-players, voice recorders or answering machines, make use of time scaling for fast forward or slow-motion audio play-out.

BACKGROUND OF THE INVENTION

The following list of applications for time-scaling audio signals can be found in Dorran et al., "A Comparison of Time-Domain Time-Scale Modification Algorithms," AES 2006:

- Fast browsing of speech material for digital libraries and distance learning
- Music and foreign language learning/teaching
- Fast/slow playback for telephone answering machines and Dictaphones
- Video-cinema standards conversion
- Audio Watermarking
- Accelerated aural reading for the blind
- Music composition
- Audio-video synchronization
- Audio data compression
- Diagnosis of cardiac disorders
- Editing audio/visual recordings for allocated timeslots within the radio/television industry
- Voice gender conversion
- Text-to-speech synthesis
- Lip synchronization and voice dubbing
- Prosody transplantation and karaoke A way of realizing such a digital signal processing technique for audio signal length change is the so-called Waveform Similarity OverLap Add (WSOLA) approach. WSOLA is capable of producing time scaled output signals of high quality. The WSOLA output signal is constructed from blocks of a fixed length (typically around 20 ms). These blocks overlap by 50% so that a fixed cross-fade length is guaranteed. The next block appended to the output signal is the one that is, first, most similar to the block that would normally follow the current block and that, second, lies within a search window around the ideal position (as determined by the scaling factor). The deviation from the ideal position is thereby typically restricted to be less than 5 ms resulting in a search window of 10 ms in size.

Demol et al. describe in, "Efficient Non-Uniform Time-Scaling of Speech with WSOLA," Speech and Computers (SPECOM), 2005, that WSOLA may also be extended to take the varying characteristics of the processed signal into account for by varying the scaling factor.

SUMMARY OF THE INVENTION

The invention aims at enhancing the WSOLA approach by proposing a method for time scaling a sequence of input signal values using a modified waveform similarity overlap add approach according to claim 1 and a device for time scaling a sequence of input signal values using a modified waveform similarity overlap add approach according to claim 9.

According said method the waveform similarity overlap add approach is modified such that a maximized similarity is determined among similarity measures of sub-sequence pairs each comprising a sub-sequence to-be-matched from a input window and a matching sub-sequence from a search window wherein said sub-sequence pairs comprise at least two sub-sequence pairs of which a first pair comprises a first sub-sequence to-be-matched and a second pair comprises a different second sub-sequence to-be-matched.

The input window allows for finding sub-sequence pairs with higher similarity than with a WSOLA approach based on a single sub-sequence to-be-matched. This results in less perceivable artefacts.

In an embodiment, said first pair comprises a first matching sub-sequences and said second pair comprises different second matching sub-sequences.

In another embodiment, said first pair and said second pair comprise a same matching sub-sequence.

Advantageously, modification of said waveform similarity overlap add approach comprises copying sub-sequences until an accumulated temporal deviation which results from said copying is equal to or larger than a predetermined minimum temporal deviation, said accumulated temporal deviation depending on an accumulated temporal duration of the copied sub-sequences and an aspired time scaling factor.

This reduces the number of splice points and thus the audibility of time scaling.

The similarity measure of each sub-sequence pair may comprise a weighting which takes into account the temporal distance between the sub-sequences of the pair.

Taking the temporal distance into account enables to bias the WSOLA approach towards preferred temporal distances.

For instance, in an embodiment, the similarity is weighted such that it is biased towards larger temporal distances.

This allows for appending longer sub-sequences which in turn makes less splicing points necessary.

In yet another embodiment of the method, the similarity is weighted such that it is biased towards temporal distances corresponding to an aspired time scaling factor.

Then, even parts of the time scaled sequence reflect the time scaling factor well.

In yet a further embodiment, the input window is determined such that it comprises at least one pause signal segment.

Splicing is known to be computationally simple for signal pauses.

And in even yet a further embodiment, the input window is determined such that it does not comprise any transient signal segment.

Splicing is known to be computationally difficult for transient signal segments.

BRIEF DESCRIPTION OF THE DRAWINGS

Exemplary embodiments of the invention are illustrated in the drawings and are explained in more detail in the following description.

In the figures.

DETAILED DESCRIPTION OF THE INVENTION

Figure 1:
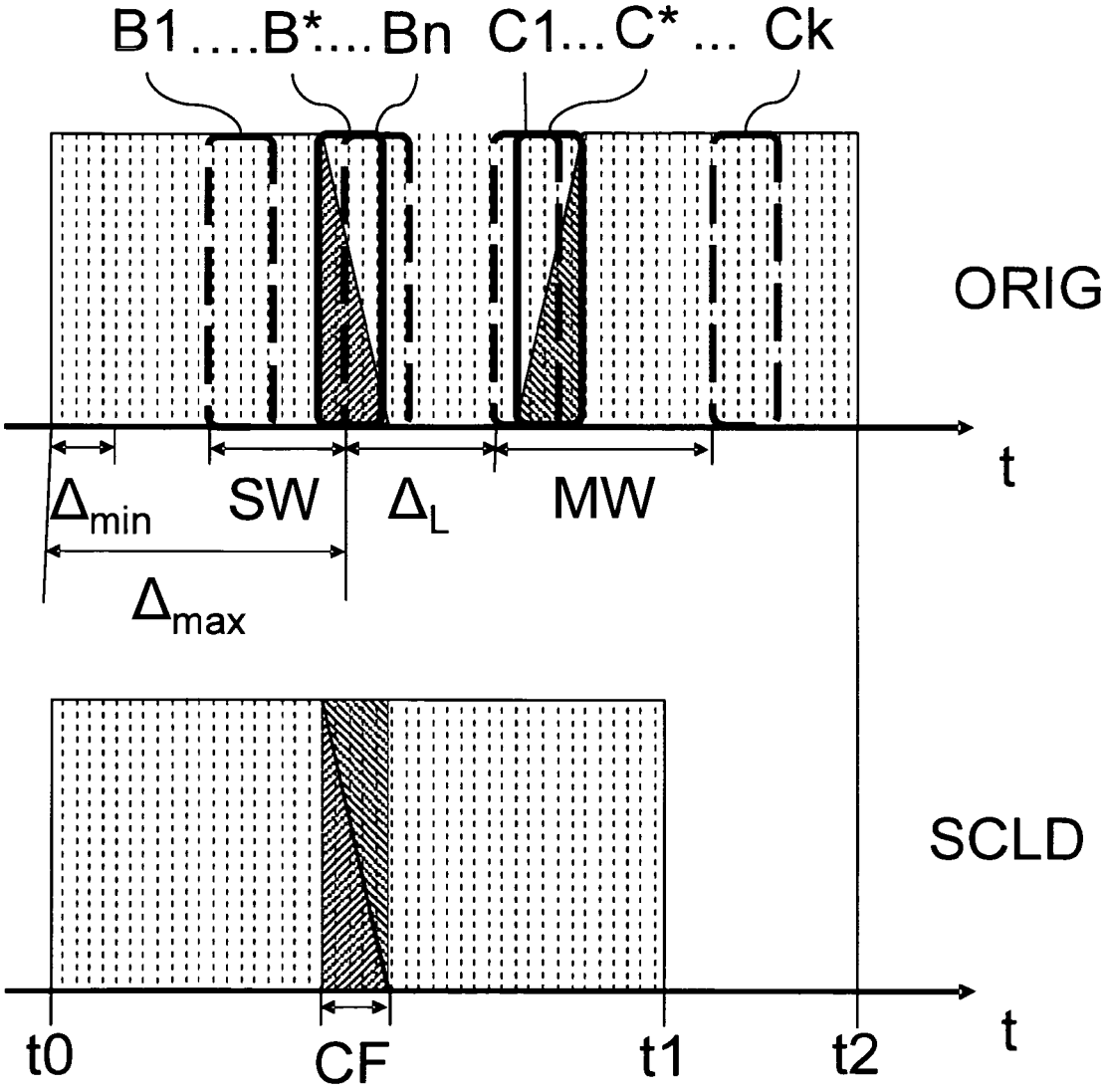
FIG. 1 depicts an exemplary original sample sequence and an exemplary time scaled sample sequence and FIG. 2 depicts exemplary weighting functions.

The exemplary embodiment of the invention realizes time scaling according to a time scaling factor $\alpha$ in a two phase process. In one of the two phases, samples of an original sample sequence ORIG are simply copied to a time-scaled sample sequence SCLD.

Let a time scaling difference be equal to the absolute of $1-\alpha$. Then, the duration of each copied sample deviates from the duration of an ideal time-scaled sample by the duration of one original sample $D_{OS}$ times the time scaling difference. Copying L samples therefore results in an accumulated temporal deviation of:

$$\Delta_L = L \cdot D_{OS} \cdot |\alpha - 1| + \Delta_0$$

wherein $\Delta_0$ is an initial temporal deviation which may be zero or which may be neglected when determining the accumulated temporal deviation.

At least as many samples are copied that the accumulated temporal deviation exceeds a lower deviation threshold $\Delta_{min}$. And, at most as many samples are copied that the accumulated temporal deviation does not exceed an upper deviation threshold $\Delta_{max}$.

The lower deviation threshold $\Delta_{min}$ ensures a minimal distance between splice points in the time scaled sample sequence. A small hop distance between splice points is problematic as the energy of audio signals tends to be concentrated in the low-frequency range so that the self-similarity function has a broad peak around zero. If $\Delta_{min}$ is a lot smaller than this peak, the template matching is likely to decide for the border of the search window being closest to the ideal point several times in a row (until the summation of $\Delta_{min}$ has surpassed the width of the above peak in the self-similarity function). In this case, the output signal will contain a concatenation of many small signal segments. The minimal distance corresponds to the cross-fade length between two copied blocks, i.e. N samples in the time-scaled signal. Ideally, $N/\alpha$ samples are used for forming these N samples in the time-scaled signal. This results in a lower deviation threshold $\Delta_{min}$ in the original signal of:

$$\Delta_{min} = N \cdot \frac{|1-\alpha|}{\alpha} D_{OS}$$

Additionally, the lower deviation threshold $\Delta_{min}$ may be determined such that it reaches at least a lower bound LB:

$$\Delta_{min} = \max\left(LB, N \cdot \frac{|1-\alpha|}{\alpha} D_{OS}\right)$$

Good results are achieved with LB=2 ms. Especially if $\alpha$ is small, the lower bounds LB helps preventing the introduction of artefacts.

The upper deviation threshold $\Delta_{max}$ ensures a maximal distance between splice points in the time scaled sample sequence. The maximal distance limits accumulated temporal deviation $\Delta_L$ and thus the length of contiguous sub-sequences of the input signal which are omitted or repeated. In turn, the audibility of artefacts due to repetition or omittance is limited too.

When copying results in the upper deviation threshold $\Delta_{max}$ being met or just exceeded, processing enters a second phase. In the second phase, a modified WSOLA is performed. For a template subsequence of N would-be-copied-next samples in the original sample sequence ORIG, a template matching is performed to find candidate subsequence C* most suitable for splicing among candidate subsequences C1, . . . , C*, . . . , Ck within a search window MW in the original sample sequence ORIG. The template matching is based on a similarity measure like a correlation, a mean square difference or a mean absolute difference which is weighted with a weight W in dependence on the temporal difference $\Delta t$ between the temporal position of the candidate subsequence and the template's position in the original sample sequence.

The weight W may further depend on an ideal temporal shift ITS of a candidate subsequence C1, . . . , C*, . . . , Ck, said ideal temporal shift ITS being determined by the candidate subsequence's temporal position in the original sample sequence ORIG and the time scaling factor.

Figure 2:
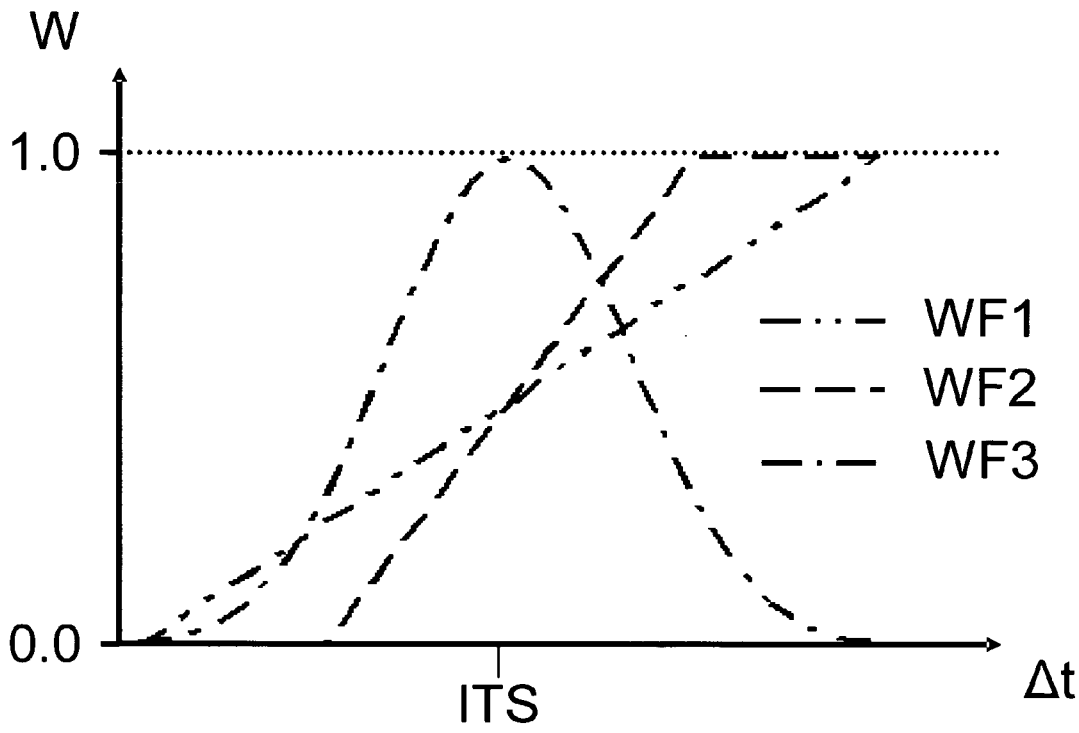

Exemplary weighting functions WF1, WF2, WF3 are schematically depicted in FIG. 2.

The weighting function may be a linear function WF1, WF2 such that the best match is biased towards those candidates which will result in a larger initial temporal deviation (retardation or pre-appearance) and thus in a larger signal segment when being appended next.

The weighting function may be a bell-shaped function WF3 such that the best match is biased towards those candidates which will result in an initial temporal deviation which corresponds best to the ideal temporal shift ITS when being appended next.

Another weighting function is useful if a film comprising synchronized audio and video signals is time-scaled. The human perceptive system is adapted to situations in which a visual impression of an event is perceived earlier than a corresponding audible impression of said event. For instance, if someone is shouting from a distance the visual impression of this event is propagated at the speed of light to an observer while the shout is propagated at the speed of sound, only. So, a small retardation of the audio signal with respect to the video signal is likely to be ignored by the observer. But, a retardation of the audio signal which is that large that the audio signal does not fit the video signal anymore is an annoying artefact. Similarly annoying is any retardation of the video signal with respect to the audio signal.

Thus, a weighting function which depends on a time-scaling achieved for the video signal such that it is ensured that the time-scaled audio signal does not lead ahead of the time-scaled video signal and at the same time is not delayed too much may be beneficial. For instance, the bell-shaped function WF3 may be centred on a shift position which ensures a small but not too large delay of the time-scaled audio signal with respect to the time-scaled video signal.

The template matching may further be performed for an subsequence comprising N last copied samples immediately preceding the sample last copied to the time-scaled sequence SCLD. The similarity between the last-but-one subsequence and its best matching template is compared with the similarity between the last subsequence and the last subsequence's best matching template wherein the similarities may or may not be weighted. The subsequence being associated with the larger weighted similarity is spliced or cross-faded with its best matching template in the time scaled sample sequence. Similarly, a set of subsequences comprising all subsequences B1, . . . , B*, . . . , Bn from a last-but-n subsequence to the last subsequence may be taken into account for maximizing the weighted similarity.

Thus the similarity measure is not only maximized for single potential splice point but for a whole set of potential splice points preferably lying dense in a input window SW. The result is a two-dimensional similarity function.

But, the additional computational effort for calculation of said two-dimensional similarity function remains limited.

For a template length of N samples and a search window width of K samples, the one-dimensional similarity function requires calculation of N*K multiplications or absolute/squared difference values etc. Then, K similarity values are determined by summing up N of the resulting values.

If $\alpha$ is closed to 1, a common search window could be used for all templates in the input window.

Then, the two-dimensional similarity function with a input window width of L requires calculation of (N+L)*K values and summing them up into L*K similarity values. Thus, the additional computational effort for the two-dimensional search grows linearly with the size of the search window.

Within the one-dimensional framework, K different similarities have to be determined while the two-dimensional framework requires calculation of L*K different similarities. But in the two dimensional framework, some of the similarities may be determined iteratively.

That is, a first sum of values determining a first similarity value of a first template with a first candidate differs only in one summand from a second sum of values determining a second similarity value of a second template with a second candidate wherein both, the second template and the second candidate, are shifted by one sample with respect to the first template respectively the first candidate.

From said L*K different similarities, only K+L similarities have to be determined from scratch, the remaining (K−1)*(L−1) similarities can be determined iteratively.

If a is much larger or much smaller than 1, a set of intersecting search windows, one per each template from the input window. Each of the search windows is centred at the point in time which corresponds to the ideal time shift of the corresponding template is used.

The input window SW may be determined such that it comprises at least one pause and/or at least one quasi-periodic signal segment. It is known that such signal segments provide good splicing points while transient signal segments are less suited for splicing or cross fading. Additionally or alternatively, the weighting of the similarity measure may be adapted such that it further or solely depends on the signal characteristics in the subsequences B1, . . . , B*, . . . , Bn wherein pausing and/or quasi-periodicity in segments to-be-spliced result in an increase of weight while transient signal characteristics result in a reduction of weight.

The pair of subsequences comprising a best matched subsequence B* from the input window SW and a best matching candidate subsequence C* from the search window MW for which the similarity is maximal, is used to generate samples of a cross-fade area CF of the time scaled signal SCLD.

The number of samples in the cross-fade area may correspond to the number of samples in one of the subsequences, such that all samples of the subsequences are used for cross-fading. Or, the number of samples in the cross-fade area is smaller, i.e., only some samples of the subsequences are used. For instance, the sub-sequence length corresponds to the length of a block or 2*N samples while the cross-fade area length corresponds to the length of half a block or N samples. Using subsequences longer than the cross-fade area may be advantageous for further reducing the audibility of splice points by biasing them towards the middle of phonemes.

There is an exemplary embodiment of the method for time scaling a sequence of signal values according to a time scaling factor, wherein said method comprises the step of time-scaling a preceding sub-sequence using a WSOLA approach and the step of time-scaling a consecutive sub-sequence using an interpolative approach.

In a further exemplary embodiment, the method comprises the steps of (a) forming subsequence pairs comprising a subsequence to-be-matched B1, B*, Bn and a matching subsequence C1, C*, Ck, (b) for each pair, determining a similarity between the subsequences comprised in the pair, (c) determining a preferred pair B*, C*, said preferred pair having a maximum similarity, (d) cross-fading the preferred matching subsequence with said preferred subsequence matched in the time scaled sequence SCLD, (e) determining the length of a to-be-copied subsequence by help of the preferred matching subsequence, (f) copying this subsequence to the time scaled sequence SCLD and returning to step (a), wherein the length of the to-be-copied subsequence depends on a threshold.

Preferably, step (b) comprises determining a weight dependent on the temporal distance between the subsequence to-be-matched and the matching subsequence of the pair.

In yet a further embodiment, step (e) comprises using the temporal factor and the temporal distance between the preferred matching subsequence and the preferred subsequence matched for determination of the length of the to-be-copied subsequence.

What is claimed is:

1. A method for time-scaling an original sample sequence by copying samples of a sub-sequence directly following a current sub-sequence of said original sample sequence to a time-scaled sample sequence which is a time-scaled version of said original sample sequence, said time-scaling and copying being based on waveform similarity overlap-add processing, said method comprising:

performing, by a processor, operations of:

appending to a current sub-sequence of said time-scaled sample sequence a copy of a subsequence of said original sample sequence, which copied sub-sequence of said original sample sequence directly follows the current sub-sequence of said original sample sequence;

if copying of samples of successive sub-sequences of said original sample sequence to said time-scaled sample sequence would result in an exceeding of a temporal deviation threshold for said time-scaled sample sequence, instead of appending a copy of a sub-sequence which directly follows a current sub-sequence of samples of said original sample sequence to the time-scaled sample sequence, appending a copy of a temporally advanced sub-sequence of samples of said original sample sequence to the time-scaled sample sequence, which temporally advanced sub-sequence of samples of said original sample sequence has a temporal position which either temporally precedes or temporally follows the temporal position of said sub-sequence which directly follows a current sub-sequence of samples of said original sample sequence wherein the temporally advanced sub-sequence is determined to be most similar to said sub-sequence which directly follows a current sub-sequence of samples of said original sample sequence, wherein the determination is based on a measure of similarity which is weighted such that the measure of similarity is biased towards a larger temporal distance between said temporally advanced sub-sequence and the current sub-sequence which is directly followed by said sub-sequence which directly follows a current sub-sequence of samples of said original sample sequence, and wherein the temporally advanced sub-sequence lies within a search window in said original sample sequence that is located at a temporal position determined by a scaling factor associated with said time-scaled sample sequence.

2. The method according to claim 1, further comprising:

determining a maximized similarity among similarity measures of multiple sample sub-sequence pairs each sample sub-sequence pair comprising a sample sub-sequence to-be-matched from an input window in said original sample sequence and a matching sample sub-sequence from said search window in said original sample sequence;

wherein said multiple sample sub-sequence pairs each comprise at least two sample sub-sequence pairs of which a first sample sub-sequence pair comprises a first sample sub-sequence to-be-matched and a second sample sub-sequence pair comprises a second sample sub-sequence to-be-matched that is different from said first sample sub-sequence to-be-matched;

and wherein said first sample sub-sequence pair comprises a first matching sample sub-sequence and said second sample sub-sequence pair comprises a second matching sample sub-sequence that is different from said first matching sample sub-sequence.

3. The method according to claim 2, further comprising:

copying sample sub-sequences from said original sample sequence until an accumulated temporal deviation for said time-scaled sample sequence which results from said copying is equal to or larger than a predetermined minimum temporal deviation, said accumulated temporal deviation depending on an accumulated temporal duration of the copied sample sub-sequences and an aspired time scaling factor.

4. The method according to claim 2, wherein each similarity measure of the similarity measures of multiple sample sub-sequence pairs is weighted by taking into account the temporal distance between the sample sub-sequences of a respective sample sub-sequence pair.

5. The method according to claim 2, wherein said input window is determined such that it comprises at least one pause signal segment.

6. The method according to claim 2, wherein said input window is determined such that it does not comprise any transient signal segment.

* * * * *